US005522754A

United States Patent [19]

Hanson

[11] Patent Number: 5,522,754

[45] Date of Patent: Jun. 4, 1996

[54] EXPANDABLE APPARATUS FOR DISPLAYING MULTIPLE PANORAMIC SCENES

[76] Inventor: Sheri Hanson, P.O. Box 40, Willits, Calif. 95490

[21] Appl. No.: 359,343

[22] Filed: Dec. 19, 1994

Related U.S. Application Data

[63] Continuation of Ser. No. 147,712, Nov. 5, 1993, abandoned.

[51] Int. Cl.[6] ..... A63H 33/30; A63H 33/38

[52] U.S. Cl. ..... 446/144; 446/152; 40/427

[58] Field of Search ..... 446/147, 148, 446/149, 150, 151, 152, 144; 40/427, 539, 577, 586; 472/72, 75; 359/462, 466, 474

[56] References Cited

U.S. PATENT DOCUMENTS

| | | | |
|---|---|---|---|
| 371,900 | 10/1887 | Pihlstrom | 446/488 |
| 678,012 | 7/1901 | Maratta | 40/539 X |
| 744,545 | 11/1903 | Hervey | 446/152 |
| 772,343 | 10/1904 | Diehl . | |
| 994,378 | 6/1911 | Douglas | 359/474 X |
| 1,044,377 | 11/1912 | Gray | 446/152 |
| 1,143,636 | 6/1915 | Lemassena . | |
| 1,194,057 | 8/1916 | Murphy | 359/474 X |
| 1,197,679 | 9/1916 | Stern | 359/474 X |
| 1,244,959 | 10/1917 | Conover | 40/577 X |
| 1,252,089 | 1/1918 | Clarke | 359/474 X |
| 1,499,891 | 7/1924 | Storer . | |
| 1,530,404 | 3/1925 | Pearce | 446/152 X |
| 1,655,989 | 1/1928 | Duval | 446/149 |
| 1,682,594 | 8/1928 | Benjamin | 40/539 X |
| 1,832,789 | 11/1931 | Polak | 446/149 X |
| 2,057,051 | 10/1936 | Owens | 359/462 |
| 2,314,721 | 3/1943 | Lowenstein . | |
| 2,544,783 | 3/1951 | Freedman et al. . | |
| 2,546,878 | 3/1951 | Townley . | |
| 2,565,553 | 8/1951 | Foley . | |
| 2,586,071 | 2/1952 | Manen-Mayol | 40/539 X |
| 2,742,723 | 4/1956 | Klein et al. . | |
| 4,865,574 | 9/1989 | Kobayashi | 40/539 X |
| 4,915,663 | 4/1990 | Magers . | |

FOREIGN PATENT DOCUMENTS

| | | | |
|---|---|---|---|
| 361784 | 11/1906 | France | 359/474 |
| 876044 | 7/1942 | France | 446/152 |
| 505599 | 12/1952 | Italy | 40/539 |

*Primary Examiner*—Robert A. Hafer
*Assistant Examiner*—D. Neal Muir
*Attorney, Agent, or Firm*—John R. Flanagan

[57] ABSTRACT

An expandable apparatus for displaying multiple panoramic scenes includes a multiplicity of plates and a plurality of folded segments disposed between and attached to opposite lateral end portions of the plates. The plates includes a front plate containing a viewing aperture, a rear plate containing a background scene thereon, and a plurality of intermediate plates disposed consecutively between the front and rear plates. The intermediate plates contain a variety of scenes thereon being complementary to the background scene on the rear plate. The intermediate plates have respective cut-outs therein for permitting observing through the viewing aperture the scenes on the rear plate and consecutive ones of the intermediate plates closer to the rear plate than to the front plate. The folded segments connect the plates so as to retain them in aligned relationship front to back with one another and permit them to be moved toward and away from each other for the viewing together of the scenes depicted on the respective intermediate and rear plates. The apparatus also has a pair of handles connected to the front and rear plates and used to move the plates toward and away from one another so as to convert the apparatus between expanded viewing and collapsed storage positions.

11 Claims, 2 Drawing Sheets

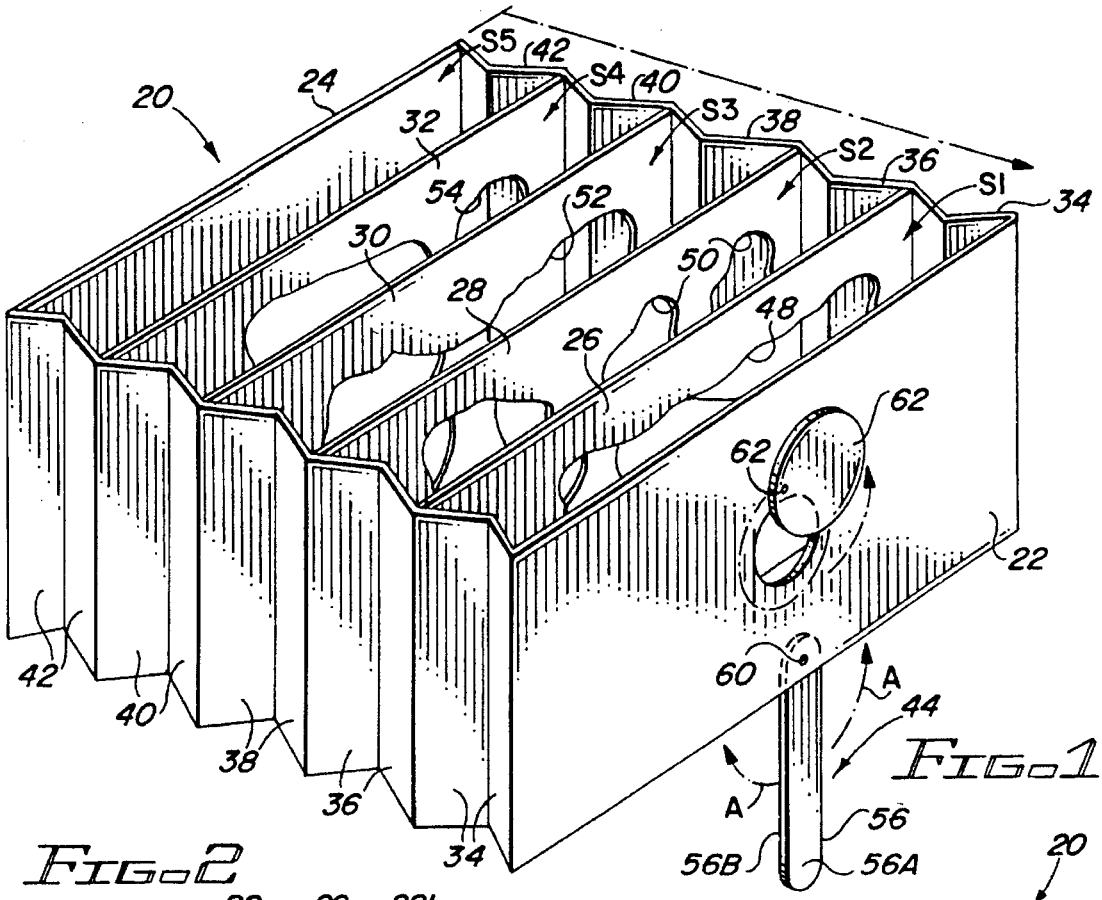
FIG. 1
FIG. 2
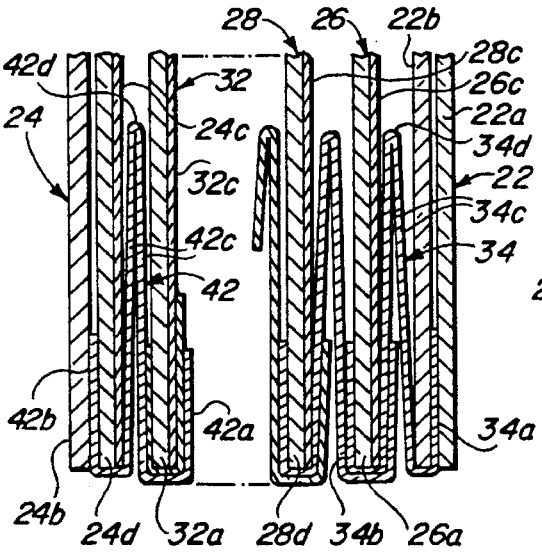
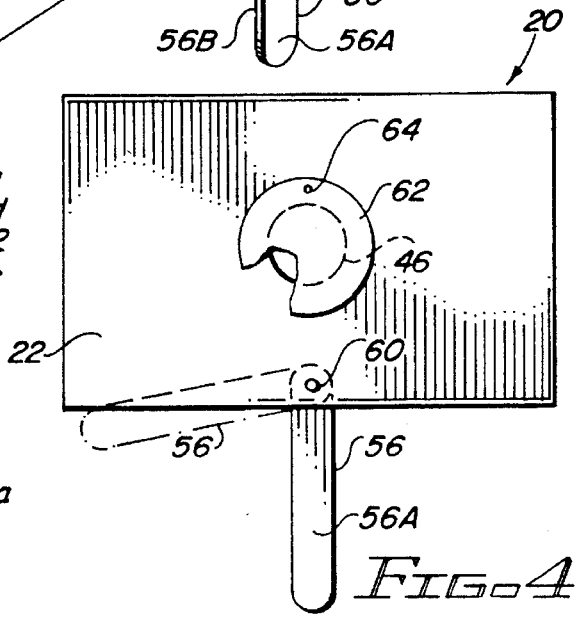
FIG. 4
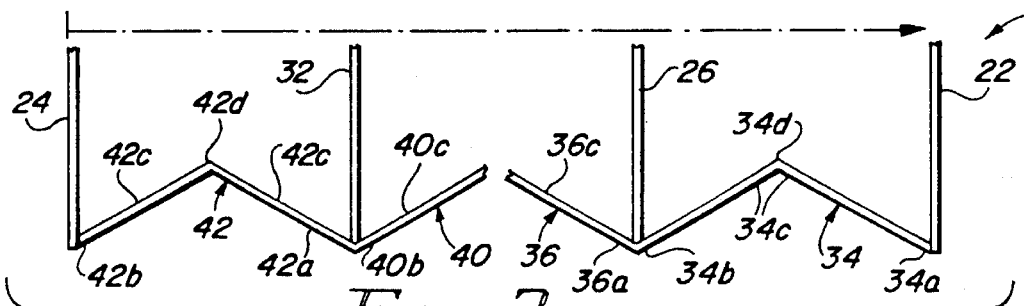
FIG. 3

EXPANDABLE APPARATUS FOR DISPLAYING MULTIPLE PANORAMIC SCENES

This application is a continuation of application Ser. No. 08/147,712, filed Nov. 5, 1993, now abandoned.

BACKGROUND OF THE INVENTION

1. Field of the Invention

The present invention generally relates to picture-building devices and, more particularly, is concerned with an expandable apparatus for displaying multiple panoramic scenes.

2. Description of the Prior Art

A variety of devices have been developed over the years for displaying pictorial scenes using a multi-dimensional framework. Such devices have been utilized in children's books wherein storybook characters emerge or "pop-up" from the pages to illustrate the particular story being told. Additionally, such multi-dimensional frameworks have found use in picture-building toys, and in advertising displays for greeting cards and the like.

Representative examples of such devices are the ones disclosed in Diehl (U.S. Pat. No. 772,343), Lemassena (U.S. Pat. No. 1,143,636), Storer (U.S. Pat. No. 1,499,891), Lowenstein (U.S. Pat. No. 2,314,721), Freedman et al (U.S. Pat. No. 2,544,783), Townley (U.S. Pat. No. 2,546,878), Foley (U.S. Pat. No. 2,565,553), Manen-Mayol (U.S. Pat. No. 2,586,071) and Klein et al (U.S. Pat. No. 2,742,723). None of the above-referenced devices, however, provide any type of handle features for holding or carrying the pictorial apparatus in the hands. Additionally, each device is somewhat limited in capacity for providing multiple scenes rich in visual complexity. Further, all of the above-referenced devices are fairly complicated in design and construction as well, thereby being fairly costly to manufacture.

Consequently, a need still exists for a pictorial apparatus simple in design and construction for inexpensive production. Such an apparatus should have the capacity for presenting a multitude of scenes together in a multi-dimensional manner so as to provide a viewing experience rich in visual complexity for the viewer. Additionally, the apparatus should have some type of simple handles for holding and carrying the apparatus and for manipulating the particular distances between the multitude of scenes presented in the apparatus.

SUMMARY OF THE INVENTION

The present invention provides an expandable apparatus for displaying multiple panoramic scenes designed to satisfy the aforementioned needs. The expandable display apparatus of the present invention avoids the drawbacks of the prior art without introducing other drawbacks in their place. Instead, the expandable apparatus of the present invention provides expanded capabilities not available in the prior art devices.

One capability is the simplicity in design and construction of the expandable apparatus for inexpensive production and for ease in use by either an adult or a child. A second capability is the multitude of scenes presented by a plurality of plates included in the apparatus so as to provide a multi-dimensional viewing experience rich in visual complexity. A third capability is a pair of handles provided by the apparatus for holding and carrying the apparatus and for manipulating the distances between the multitude of scenes provided on the plurality of plates of the apparatus.

Accordingly, the present invention is directed to an expandable apparatus for displaying multiple panoramic scenes. The expandable display apparatus comprises: (a) a multiplicity of plates including a front plate containing a viewing aperture, a rear plate, and a plurality of intermediate plates disposed consecutively between the front and rear plates, each of the rear and intermediate plates containing one of a variety of scenes thereon, the intermediate plates having means for permitting viewing through the intermediate plates in order to observe the scenes on the rear plate and on consecutive ones of the intermediate plates closer to the rear plate than to the front plate; (b) means for interconnecting the multiplicity of plates to one another at opposite lateral end portions thereof so as to retain the plates in an aligned relationship front to back with one another and permit the plates to be moved toward and away from each other for the viewing together of the scenes depicted on the respective intermediate and rear plates; and (c) means for moving the plates toward and away from one another between an expanded viewing position and a collapsed storage position. The moving means is a pair of handles being respectively connected to the front and rear plates and being movable between deployed and stored positions.

More particularly, each of the multiplicity of plates is a flat planar sheet of semi-rigid construction and rectangular configuration. The plates are substantially identical in size to one another.

The interconnecting means includes a plurality of pairs of folded segments being substantially identical in size to one another. Each pair of segments is respectively disposed between opposite lateral end portions of pairs of consecutive plates and is attached to one of the pair of plates and overlaps with and is attached to one of the end portions of the next successive folded segment. Each folded segment has portions hingedly connected together at a fold line. The attachment of the pairs of folded segments between the respective pairs of consecutive plates retains the plates in the aligned relationship front to back with one another and permits the plates to be moved toward and away from each other.

The pair of handles are straight flat shafts having a pair of opposite ends. The handles are each attached at one end to the bottom edge of the front and rear plates. The remainder of the handles are free for clasping by the fingers of the hand. Each handle is movable from a deployed position in which it extends downwardly from and substantially perpendicular to the front and rear plates to a stored position in which it rests adjacent to and alongside the bottom edge of the front and rear plates.

The viewing aperture defined in the front plate has a circular configuration and is located in approximately the center of the front plate. The expandable apparatus also includes a closure element attached on the front plate. The closure element is a circular disk slightly greater in diameter than the viewing aperture and movable between an opened position in which the disk is located to one side of the viewing aperture and a closed position in which the disk is located in an overlying relation to the viewing aperture.

The viewing means of the intermediate plates are respective cutouts complementary in shape to the scenes depicted thereon such that the scene presented on each consecutive intermediate plate and the rear plate can be viewed together as one multi-dimensional scene through the viewing aperture disposed on the front plate.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of the expandable display apparatus of the present invention, being shown disposed in an expanded viewing position for viewing the multiple scenes contained therein.

FIG. 2 is a fragmentary sectional view of the expandable apparatus, being shown disposed in a collapsed storage position.

FIG. 3 is a foreshortened fragmentary view of the expandable apparatus, being shown disposed in the expanded viewing position.

FIG. 4 is a front elevational view of the front plate of the expandable apparatus, showing the closure element, partly cut away, in a closed position overlying the viewing aperture defined in the front plate of the apparatus.

DETAILED DESCRIPTION OF THE INVENTION

Figure 9:
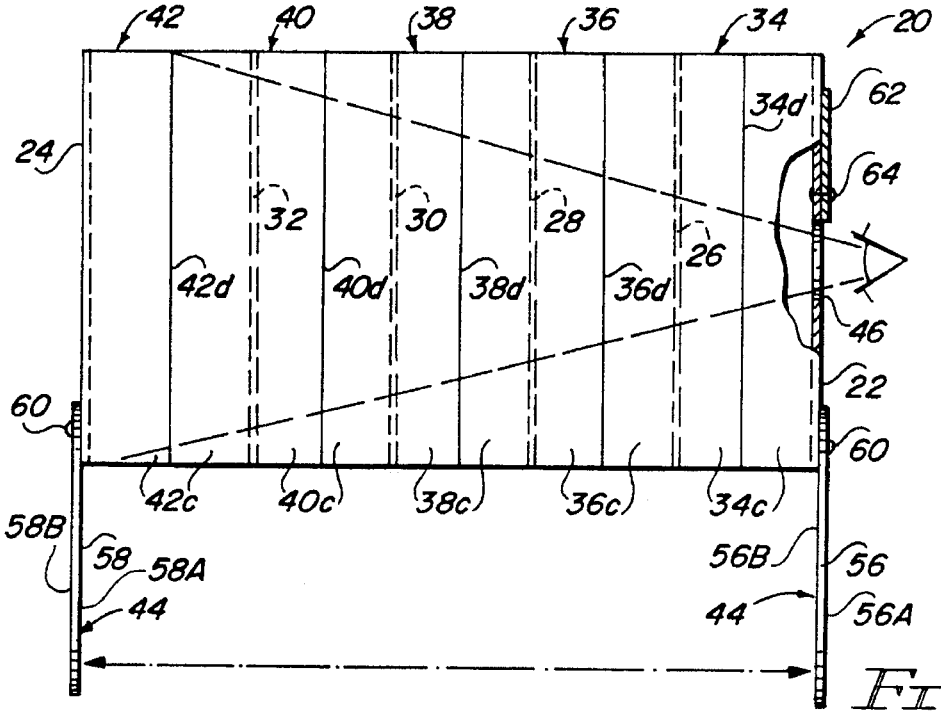
FIG. 9 is a side elevational view of the expandable apparatus with portions sectioned to reveal the viewing aperture, the apparatus being shown disposed in an expanded viewing position, with the front, intermediate and rear plates disposed front to back in an aligned spaced relationship.

Referring to the drawings and particularly to FIGS. 1–4 and 9, there is illustrated an expandable display apparatus, generally designated 20, of the present invention. The expandable apparatus 20 is adapted for displaying a variety of panoramic scenes S1–S5. Basically, the expandable display apparatus 20 includes a multiplicity of plates 22–32, interconnecting means in the form of a plurality of pairs of folded segments 34–42 interconnecting the plates 22–32 and means 44 for moving the plates 22–32 toward and away from one another between an expanded viewing position, as seen in FIGS. 1, 3 and 9, and a collapsed storage position, as partly seen in FIG. 2.

Figure 5:
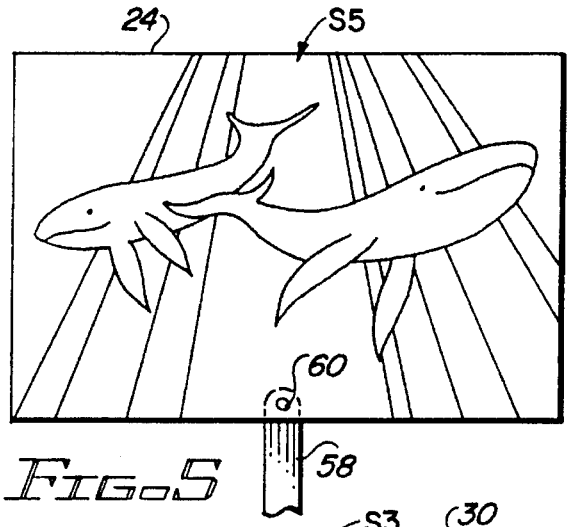
FIG. 5 is a front elevational view of the rear plate of the expandable apparatus, showing the background scene contained thereon.
Figure 6:
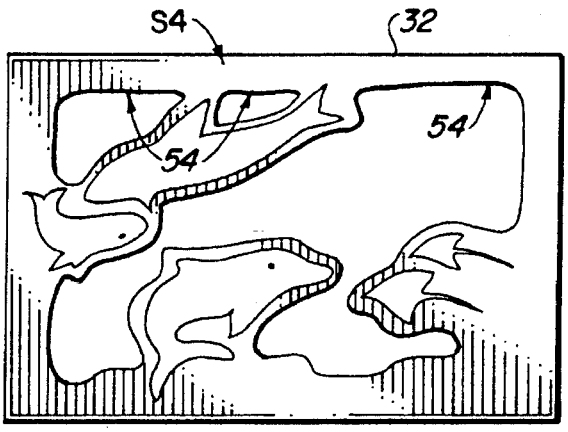
FIG. 6 is a front elevational view of a first one of the intermediate plates of the expandable apparatus, showing a scene contained thereon adjacent to a central cutout region thereof.
Figure 7:
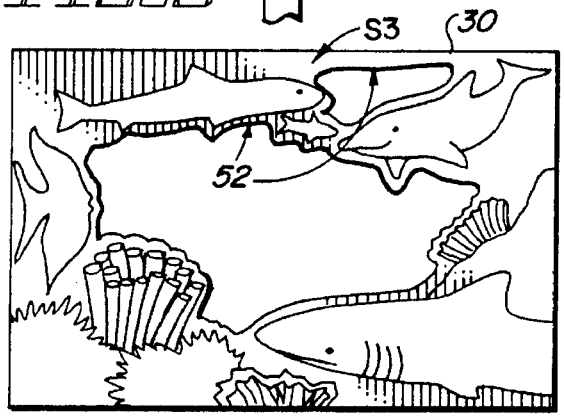
FIG. 7 is a front elevational view of a second one of the intermediate plates of the expandable apparatus, showing a scene contained thereon adjacent to a central cutout region thereof.

Referring to FIGS. 1–9, the multiplicity of plates 22–32 includes a front plate 22, a rear plate 24 and a number of intermediate plates 26–32 consecutively arranged with respect to one another between the front and rear plates 22, 24. The front plate 22 contains a viewing aperture 46. Each of the rear plate 24 and intermediate plates 26–32 contain one of the variety of scenes S1–S5 on the respective front sides thereof facing toward the front plate 22. By way of example, as shown in FIGS. 5–7, the rear plate 24 contains a background scene S5 and the intermediate plates 26–32 (only two of which are shown) contain respective scenes S1–S4 being complementary to the background scene S5 on the rear plate 24. The underwater scenes are shown in FIGS. 5–7 as examples.

Preferably, the front and rear plates 22 and 24 are formed by a pair of flat planar thick sheets **22*a*, 22*b* and 24*a*, 24*b* of a suitable semi-rigid material, such as paperboard whereas the intermediate plates 26–32 are formed of a single flat planar sheet 26*a*–32*a* of the same material, such as paper board. Also, preferably, the scenes S1–S5 are printed on flat planar thin sheets 24*c* and 26*b*–32*b* of a suitable flexible material which is attached to the thick sheets 24*a*–32*a*. Further, the front and rear plates 22, 24 and the intermediate plates 26–32** are substantially identical in size to one another and have a generally rectangular configuration although other shapes are possible.

Each pair of folded segments 34–42 is respectively disposed between opposite lateral end portions of pairs of consecutive plates 22–32. The opposite end portions **34*a*, 34*b* to 42*a*, 42*b* of the segments are respectively attached to one of the pair of plates 22–32 and overlaps and attached to one of the end portions of the next successive folded segment 34–42. Each folded segment has middle portions 34*c* hingedly connected together at a fold line 34*d* and is substantially identical in size to the other folded segments. The attachment of the pairs of folded segments 34–42 between the respective pairs of consecutive plates 22–32 retains the plates in a desired aligned relationship front to back with one another and permits the plates to be moved toward and away from each other. The folded segments of the pairs 34, 42 thereof are constructed of a suitable flexible sheet material, such as a paper material, which has is substantially smaller in thickness than the thick sheets of the plates 22–32**.

Figure 8:
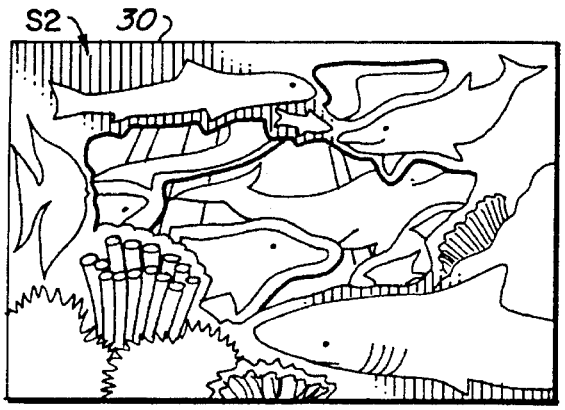
FIG. 8 is a front elevational view of the rear plate of FIG. 5 with the first and second intermediate plates of FIGS. 6 and 7 being aligned with and superimposed over the rear plate.

Referring to FIGS. 1 and 5–8, the intermediate plates 26–32 also have means for permitting viewing through the intermediate plates in order to observe the scenes S1–S5 on the rear plate 24 and on the consecutive ones of the intermediate plates 26–32 successively closer to the rear plate 24 than to the front plate 22. Such view means on the intermediate plates 26–32 are respective cutouts 48–54 therein for permitting viewing therethrough to observe the scenes S1–S5 on the rear plate 24 and succeeding ones of the intermediate plates 26–32 closer to the rear plate 24 than to the front plate 22. Preferably, the cutouts 48–54 have different irregular shapes but are complementary in shape to the various scenes depicted on the intermediate plates 26–32 such that the scene presented on each consecutive intermediate plate and the rear plate can be viewed together as one multi-dimensional scene through the viewing aperture 46 disposed on the front plate 22, as seen in FIG. 8.

Referring to FIGS. 1, 4 and 9, the moving means 44 of the expandable apparatus 20 preferably takes the form of a pair of handles 56, 58 respectively connected to the front and rear plates 22, 24. The handles 56, 58 are respectively connected to the front and rear plates 22, 24 for movement laterally or sideward within planes disposed parallel to the planes of the front and rear plates 22, 24 and in the direction of the arrows A in FIG. 1 between deployed and stored positions. Each of the handles 56, 58 can be a flat shaft having a pair of opposite ends and a pair of oppositely facing front and rear surfaces 56A, 56B and 58A, 58B which respectively extend within planes disposed parallel to the respective plane in which the flat shaft of the respective handle 56, 58 extends and moves between the deployed and stored positions relative and parallel to the plane of the respective one of the front and rear plates 22, 24. At one end the handle 56, 58 is pivotally connected by a suitable fastener such as a rivet 60 adjacent to a bottom edge of the one of the front and rear plates 22, 24. When moved to the deployed position, as shown in full line form in FIGS. 1, 4 and 9, the respective handles 56, 58 extend substantially downwardly from the respective one of said front and rear plates 22, 24. On the other hand, in the stored position, as shown in dashed line form in FIG. 4, each handle rests adjacent to and alongside the bottom edge of the respective one of the front and rear plates. As each handle 56, 58 is moved from the deployed position to stored position, it increasingly overlaps and assumes a substantially side-by-side relationship with the respective one of the front and rear plates 22, 24 and thereby decreasingly extends downwardly from the respective one of the front and rear plates 22, 24 as the handle reaches the stored position compared to the deployed position. Thus, when in the deployed position, one of the front and rear surfaces 56A, 56B and 58A, 58B of the flat shaft forming the respective handle 56, 58 is disposed in the substantially side-by-side relationship with a respective one of the front and rear plates 22, 24.

Referring to FIG. 1, 4 and 9, the viewing aperture 46 defined in the front plate 22 preferably has a circular configuration and is located in approximately the center of the front plate 22. The expandable display apparatus 20 further includes a closure element 62 attached by a suitable fastener 64, such as a rivet, on the front plate 22 adjacent to the viewing aperture 46. The closure element 62 can undergo pivotal movement between a closed position (FIG. 4) in which the closure element 62 is located in an overlying relation to the viewing aperture 46 and an opened position (FIG. 1) in which the closure element 62 is displaced to one side of the viewing aperture 46. Preferably, as can be seen in FIGS. 1, 4 and 9, the closure element 62 is a circular disk being slightly greater in diameter than the viewing aperture 46.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An expandable apparatus for displaying multiple panoramic scenes, said apparatus comprising:

(a) a multiplicity of plates including a front plate containing a viewing aperture, a rear plate, and a plurality of intermediate plates disposed consecutively between said front and rear plates, each of said rear and intermediate plates containing one of a variety of scenes thereon, said intermediate plates having means for permitting viewing through said intermediate plates in order to observe said scenes on said rear plate and on succeeding ones of said intermediate plates closer to said rear plate than to said front plate;

(b) means for interconnecting said multiplicity of plates to one another at opposite lateral end portions thereof so as to retain said plates in an aligned relationship front to back with one another and permit said plates to be moved toward and away from each other for the viewing together of said scenes depicted on said respective intermediate and rear plates; and (c) means for moving said plates toward and away from one another between an expanded viewing position and a collapsed storage position, said moving means including a pair of handles respectively connected to said front and rear plates and being movable sideward between deployed and stored positions, each of said handles being a flat shaft having a pair of opposite ends, each flat shaft being pivotally connected at one of said opposite ends to a bottom edge of a respective one of said front and rear plates such that said flat shaft extends within and is movable sideward within a plane disposed parallel to the respective one of said front and rear plates between said deployed position in which said flat shaft extends downwardly from said respective one of said front and rear plates and said stored position in which said flat shaft rests adjacent to and alongside said bottom edge of said respective one of said front and rear plates, said each flat shaft in being moved from said deployed position to said stored position increasingly overlaps and assumes a substantially side-by-side relationship with said respective one of said front and rear plates and thereby decreasingly extends downwardly from said respective one of said front and rear plates as said flat shaft reaches said stored position compared to said deployed position, said each flat shaft also having a pair of oppositely facing front and rear surfaces which extend within planes parallel to said plane in which said flat shaft extends and moves between the deployed and stored positions parallel and relative to said plane of the respective one of said front and rear plates such that one of said front and rear surfaces of said flat shaft is disposed in said substantially side-by-side relationship with said respective one of said front and rear plates in said stored position of said flat shaft.

2. The apparatus of claim 1 wherein each of said flat shafts is respectively pivotally connected at said one of said opposite ends thereof by a rivet to one of said front and rear plates for movement between said deployed and stored positions.

3. The apparatus of claim 1 wherein each of said plates is a flat planar sheet of semi-rigid construction and rectangular configuration, said plates being substantially identical in size to one another.

4. The apparatus of claim 1 wherein said interconnecting means is a plurality of pairs of folded segments each folded segment having portions hingedly connected at a fold line.

5. The apparatus of claim 4 wherein each of said pairs of folded segments are respectively disposed between and attached with said opposite lateral end portions of pairs of consecutive ones of said front, rear and intermediate plates.

6. The apparatus of claim 1 wherein said viewing aperture defined in said front plate has a circular configuration and is located in approximately the center of said front plate.

7. The apparatus of claim 1 further comprising:

a closure element attached on said front plate for undergoing movement between a closed position in which said closure element is located in an overlying relation to said viewing aperture and an opened position in which said closure element is displaced to one side of said viewing aperture.

8. The apparatus of claim 7 wherein said closure element is a circular disk slightly greater in diameter than said viewing aperture.

9. The apparatus of claim 1 wherein said means for permitting viewing through said intermediate plates are cutouts in said intermediate plates for observing through said viewing aperture said scenes on said rear plate and on consecutive ones of said intermediate plates closer to said rear plate than to said front plate.

10. The apparatus of claim 9 wherein said cutouts are complementary in shape to said scenes depicted on said intermediate plates such that the scene presented on each consecutive intermediate plate and the rear plate can be viewed together as one multi-dimensional scene through said viewing aperture disposed on said front plate.

11. The apparatus of claim 9 wherein said cutouts have different irregular shapes.

* * * * *